73-652
12/16/80 XR SR 4,239,234

United States Patent [19]
Ward

[11] 4,239,234
[45] Dec. 16, 1980

[54] PNEUMATIC TARGET SYSTEM

[75] Inventor: Frederick D. Ward, St. Foy, Canada

[73] Assignee: Her Majesty the Queen in right of Canada, as represented by the Minister of National Defence, Ottawa, Canada

[21] Appl. No.: 5,740

[22] Filed: Jan. 23, 1979

[51] Int. Cl.³ ..... F41J 7/04
[52] U.S. Cl. ..... 273/391; 73/652
[58] Field of Search ..... 273/102.1 R, 102.1 C, 273/102.1 E, 105.6, 53, 378, 386, 390, 391, 392; 73/652

[56] References Cited

U.S. PATENT DOCUMENTS

| | | | |
|---|---|---|---|
| 3,248,110 | 4/1966 | Webb | 273/53 X |
| 3,267,725 | 8/1966 | Connaught | 73/652 |
| 3,733,073 | 5/1973 | Gutler | 273/105.6 X |
| 4,189,945 | 2/1980 | Whiting | 73/652 |

FOREIGN PATENT DOCUMENTS

| | | | |
|---|---|---|---|
| 2029541 | 12/1971 | Fed. Rep. of Germany | 273/372 |

*Primary Examiner*—Anton O. Oechsle
*Attorney, Agent, or Firm*—Nathan Edelberg; Robert P. Gibson; A. Victor Erkkila

[57] ABSTRACT

A sensing apparatus is described for use in a target indicating system operative selectively to signal a strike on a target plate. The target indicating system includes an actuator mechanism adapted to be driven by a pressurized gas, conduit and servo control means in flow communication with the actuator mechanism and adapted, in use, to supply gas under pressure to the actuator mechanism. A strike sensing apparatus or assembly is also included, connectible, in use, to the conduit and servo control means. This sensing apparatus includes a housing defining a cylinder therein having one portion thereof adapted to be in flow communication with the source of pressurized gas. A piston is provided being slidably movable in the cylinder. The piston has a bleed channel therein to depressurize the cylinder. A motion-sensitive weight, preferably in the form of a sphere, is supported by the piston and acts on a needle valve to keep the bleed channel closed. This weight is moveable in response to a strike on the target plate, enabling the bleed channel to be uncovered, thereby causing rapid depressurization of the cylinder and a correspondingly rapid lowering of the target. Preferably the weight is a spherical ball and the stem portion of the piston is formed with a spherical seat for supporting said ball. In another preferred form of this apparatus, biasing means are included, supported in the cylinder housing to cause retraction of the piston when the cylinder has been depressurized.

7 Claims, 2 Drawing Figures

PNEUMATIC TARGET SYSTEM

This invention relates to a target indicating system operative selectively to signal a strike on a target plate, in addition to enabling movement of the target plate to a raised position and a lowered position. More specifically, this invention describes a target indicating system that is operated pneumatically.

BACKGROUND OF THE INVENTION

It is often necessary on a firing range to provide a target that can be raised or lowered by remote control, and which, in addition, will fall when hit, i.e. when a bullet strikes it. Such a target indicating system should require a minimum of maintenance, and often should be ready for immediate use after long periods of disuse. In addition, the need to provide auxiliary equipment to render such a target indicating system operative should also be minimal.

Target indicating systems have commonly been constructed using components operated electrically. Thus, electric cables span the distance between the target and a control point where a supply of electrical power is provided. An electrical motor, electromagnet or the like is then actuated to place the target into an operable condition ready for use. Some kind of vibration sensor is attached to the target to signal a strike on the same. Such a sensor could, for example, be arranged to cause a light to glow, a bell to ring, or otherwise signal a strike on the target.

Present day target indicating systems have limitations which are aggravated by adverse environmental conditions. Indoor firing ranges are frequently subject to dusty or sandy conditions. Outdoor firing ranges are also subject to these conditions and, as well, are subject to corrosion or electrical shorts due to rain, ice or snow. Electrical faults are frequently time consuming to locate and repair. An additional disadvantage arises from the fact that electrical power must sometimes be provided at what might very well be a remote location. Outdoor firing ranges usually fall into that catagory.

SUMMARY OF THIS INVENTION

The present invention eliminates many of the serious problems associated with an electrically powered target indicating system. The present invention is embodied in a target indicating system which is largely uneffected by a lack of suitable electrical power, extremes of heat, cold or humidity, and requires only the provision of a commercially available bottle of gas under pressure. Such a supply of pressurized gas serves as the source both for operating the system and for signalling a strike on the target.

Accordingly, there is provided in a target indicating system operative selectively to signal a strike on a target plate in addition to selectively moving the target plate to a raised operative position and a lowered inoperative position, the combination of an actuator mechanism adapted to be driven by a pressurized gas, the actuator mechanism being operatively coupled to the target plate, to cause selective movement thereof to said lowered and raised positions; conduit and servo control means in gaseous flow communication with the actuator mechanism, said conduit and servo control means, in use, being adapted to supply said pressurized gas to the actuator mechanism; and a strike sensing assembly connectible, in use, to the conduit and servo control means, the sensing assembly including a motion-sensitive valve means operative in response to a strike on the target plate, to cause a predetermined bleed of the pressurized gas thereby to enable selected rapid movement of the target plate to the lowered position indicative of a strike.

In another aspect, the present invention is embodied in an apparatus adapted for use in a target indicating system having a target plate, such apparatus being operative to indicate a strike on the target plate, and comprising; a housing defining a cylinder therein, one portion of the cylinder being adapted to be in flow communication with and pressurizeable by a source of pressurized gas; a piston having a stem portion and a head portion in sealed engagement with the cylinder, and being slideably moveable in the cylinder, the piston having a bleed channel therein adapted to place the pressurizeable portion of the cylinder in flow communication with atmosphere; valve means for closing the bleed channel; and a motion-sensitive weight adapted to be removeably supported by the stem portion of the piston to activate the valve means to keep the bleed channel closed, the weight being supported in a manner so as to be displaceable in response to a strike on the target plate to cause activation of the valve means to uncover the bleed channel, thereby causing rapid depressurization of the cylinder and a correspondingly rapid lowering of the target plate to indicate a strike thereof.

In a more preferred form of this apparatus the motion-sensitive weight is a spherical ball, and the stem portion of the piston is formed with a spherical seat for receiving and supporting the ball.

BRIEF DESCRIPTION OF THE DRAWINGS

The present invention will be described in greater detail below, having reference to the accompanying drawings, in which.

DESCRIPTION OF THE PREFERRED EMBODIMENTS

Figure 1:
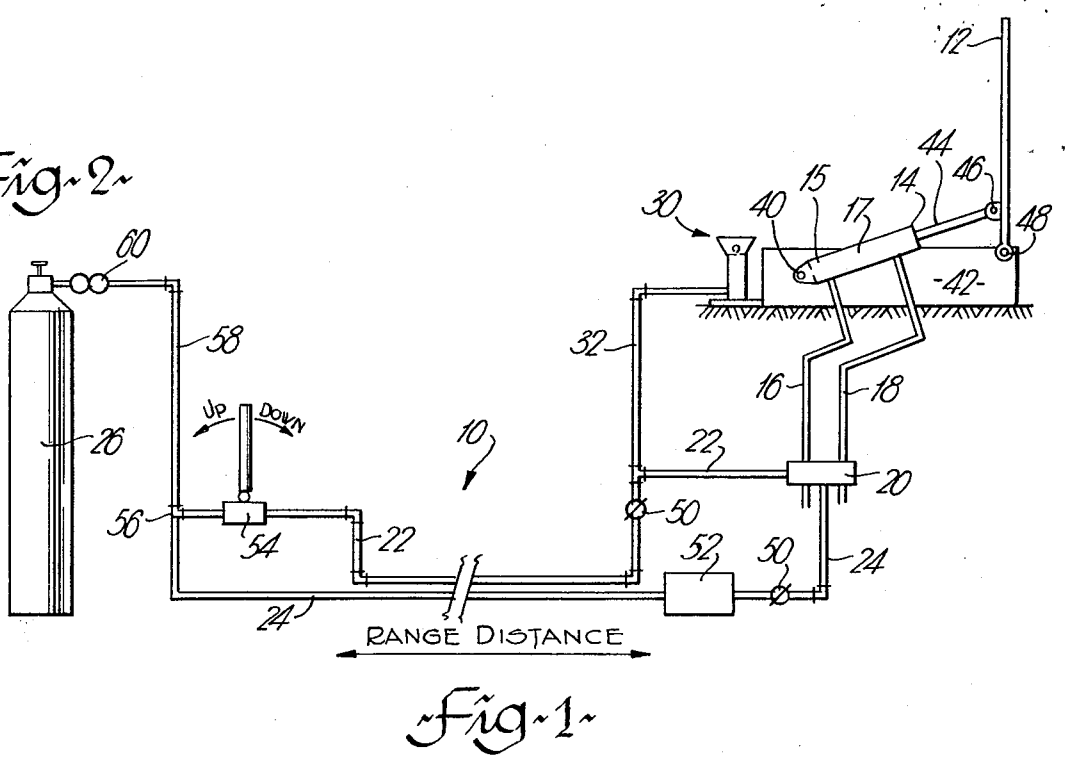
FIG. 1 is a schematic view showing a target indicating system which embodies the present invention.

In turning to the drawings, FIG. 1 shows schematically a target indicating system 10 such as would commonly be used on a small-arms firing range. The target indicating system 10 broadly includes a target plate 12 that is moveable selectively to a raised operative position and a lowered inoperative position by means of an actuator mechanism 14. The actuator 14 is operated by pressurized gas conducted to it by conduits 16 and 18 and a servo valve mechanism 20. The servo valve 20 is supplied with gas under pressure by supply lines 22 and 24 which are connected to a supply 26 of a dry pressurized gas. A strike sensing assembly in the form of a hit sensor 30 is connected by a conduit 32 to the conduit 22 supplying pressurized gas to the servo valve 20.

The actuator mechanism 14 generally comprises a piston and cylinder arrangement, with gas under pressure being conducted selectively by conduits 16 and 18 to opposite ends 15, 17 of the cylinder. Actuator 14 is commercially available, e.g., "BIMBA"* Model 316-DXP. The actuator mechanism 14 is supported at one end by a pivot pin 40 to a base 42. Rod 44 of the piston projects from the other end of the actuator 14. This extension 44 is pivotally connected at 46 to the target plate 12. The target plate 12 is itself pivotally connected at 48 to the base 42. The servo control valve 20 functions to cause gas under pressure to be conducted by the conduit 16 to the end 15 of the cylinder, causing extension of the rod and pivotal movement of the target plate 12 to a raised, operative position. In that raised position the target plate 12 will be visible to the person who is target shooting. Conduction of gas under pressure by conduit 18 to the opposite end 17 of the cylinder in actuator mechanism 14 causes retraction of the rod and pivotal movement of the target plate 12 to a lowered, inoperative position.

*A Trademark

The servo control valve 20 is a unit commercially available. One such valve suitable for use in the target indicating system 10 is made by Scovill, Model Number 41052. Besides including connections for the conduits 16, 18, 22 and 24, the servo valve 20 also includes two exhaust ports to enable depressurization selectively of one or other end of the cylinder of the actuator mechanism 14.

It is also noted here that conduits 22 and 24 contain flow constrictions indicated at 50. These can simply be a flow constriction where the conduit diameter has been reduced, and functions to limit the volume flow rate of gas through the same for purposes to be described below. A reservoir 52 is also provided in one of the conduits 22 and 24. Also included in conduit 22 is a control valve 54. This control valve 54 functions to direct the flow of gas under pressure so as to enable the target plate 12 either to be raised or lowered. Thus, the control valve 54 is activatable to an "up" or "down" position, taken with respect to positioning of the target plate 12. The control valve 54 is conventional and available commercially. In the present instance a control valve Model Number 52383 was used, as manufactured by Scovill-Schrader. The conduits 22 and 24 are joined together as shown at 56 generally in the vicinity of the control valve 54. A single conduit 58 then connects via a flow regulating valve 60 to the bottle 26 of gas under pressure.

The bottled gas is dry and commonly supplied at a pressure of about 2,500 pounds per square inch reduced to 50 to 100 psi by pressure regulator 60. In addition, the conduits which conduct the pressurized gas from the pressure regulator 60 to the strike sensing mechanism 30 and target plate actuator 14 are preferably made of a polymeric material, such as polyethylene or the like, and are of a size having an internal diameter from approximately $\frac{1}{8}$ to 3/16 inches. Although not shown in FIG. 1, placement of the target plate 12 is commonly in the order of 100 to 400 yards downrange from the supply 26 of bottled gas and the control valve 54. The supply 26 of pressurized gas is preferably air or nitrogen under pressure. Further, this bottled gas is dry, i.e. free of moisture which could condense or cause other problems within the hardware comprising the target indicating system 10. Typically, a commercially available bottle of gas under pressure contains about 240 std. cu. ft., sufficient for about three thousand operations of the target.

Figure 2:
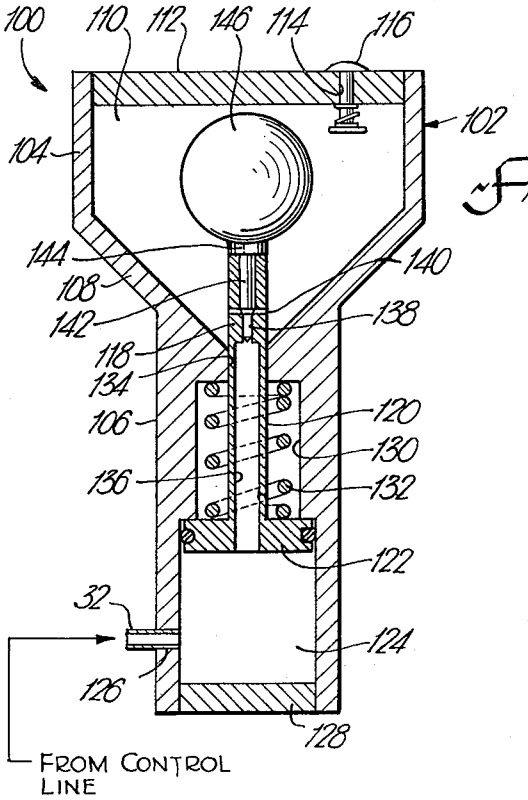
FIG. 2 is a side elevation view, taken in section, to show details of apparatus included in the target indicating system of FIG. 1, and embodying another aspect of this invention.

Turning now to FIG. 2, there is shown at 100 a preferred form of apparatus which makes up the strike sensing mechanism shown at 30 in FIG. 1. This apparatus 100 comprises a cylindrical housing 102 having a head portion 104 and a stem section 106. These two sections 104 and 106 are joined by a conically shaped section 108. The head section 104 defines a chamber or cavity 110 which is closed and sealed at one extremity thereof by a cover 112. This cover 112 is provided with an orifice 114 adapted to be selectively closed by a one-way valve assembly 116. This valve means 116 can be a mushroom-type valve biased to a closed position by means of a spring, as shown, or could even be in the form of a flap made of an elastomeric material.

The other extremity of the chamber 110 is closed by the stem portion 118 of a piston 120 whose head portion 122 is in sealed, slidable engagement with the interior walls of a cylinder 124. The cylinder 124 is adapted to be in flow communication with the conduit 32 as shown at 126.

The cylinder 124 is closed at one end 128 thereof, and is provided with a spring retaining cavity 130 at the other end thereof. A coil spring 132 is contained in the cavity 130, and functions to bias the piston to a retracted position. As seen in FIG. 2, one end of the cavity 130 opens into the cylinder 124, while the other end is closed and provided with a bore hole 134 that defines guide means for the stem portion 118 of the piston 120.

The piston 120 is provided with an internal channel 136 which is in communication with a bleed channel 138 and outlet ports 140 provided in the free end of the stem section 118. The bleed channel is configured to closely receive a needle valve 142. The needle valve 142 is provided with an enlarged head section 144 which defines a spherically shaped seat for a motion-sensitive weight in the form of a steel ball 146. The exact dimensions of the internal channel 136, bleed channel 138 and outlet ports 140 are not critical, but are related to the volume flow rate of gas passed through the constrictions 50. The size of these channels and ports 136, 138 and 140 must be no smaller than that which would pass a volume flow rate of gas at the operating pressure of the system, which exceeds the volume flow rate of gas passed by the constrictions 50, again under the same operating pressure.

The following example will illustrate how the target indicating system 10 and strike sensing mechanism 100 are intended to operate. When it is intended to put the target indicating system 10 into operation, say following an indefinite period of disuse of the same, a commercially obtained bottle of dry gas under pressure is connected to the conduit 58, for example, by connection to the pressure regulator 60. It is in this instance assumed that during a period of disuse, the control and servo valves and actuator mechanisms are not under any gaseous pressure. Further, it is assumed that the target plate was in the lowered, inoperative position.

Activation of the control valve 54, i.e. moving a lever or button thereof in a direction signifying "up" enables pressurized gas to flow, in this instance, through conduit 22 and flow constriction 50 to one inlet to the servo valve 20. This valve is so constructed as to subsequently enable the pressurized gas to flow into the conduit 16 while opening the other conduit 18 to atmosphere by one of the two exhaust ports on that valve. The pressurized gas from conduit 16 flows into the cylinder of the actuator mechanism 14, causing the piston therein to be moved, thereby pivotally moving the target plate 12 to a raised, operative position.

At the same time, pressurized gas enters the conduit 32 and is conducted to the cylinder 124 of the strike sensing apparatus 100. In a depressurized conduit, the biasing spring 132 had pushed the piston 120 to a retracted position. In that position the spherical ball 146 had been carried or conducted automatically by the conically shaped section 108 to a rest position in which the ball is seated on the spherical seat 144. The weight of the ball 146 ensures that the needle valve 142 is fully seated or inserted in the bleed channel 138 to sealably close the same. When pressurized gas enters the cylinder 124 it exerts a force against the head 122 of the piston 120. The strength of the coil spring 132 is relatively low, and is so chosen as to be easily overcome by the gaseous pressure force against the head 122 of the piston 120. Thus, entry of pressurized gas into the cylinder 124 causes the piston to be pushed to an extended position in which the ball 146 remains supported on the needle valve seat 144 but is somewhat above the conical surface of the section 108.

A bullet striking the target plate 12 generates a considerable shock or impact load on that plate and its base 42. Since the strike sensing mechanism 30 is disposed on base 42 (see FIG. 1), the shock load is translated into vibrations which are transmitted to the stroke sensing apparatus 100. These vibrations cause the motion-sensitive steel ball 146 to be displaced from the seat 144. This enables the gas pressure acting within the channel 136 and bleed channel 138 to lift needle valve 142 sufficiently to uncover or open the outlet ports 140. Gas under pressure is thus conducted from the cylinder 124 into the chamber 110. A slight amount of pressure in excess of ambient pressure will cause the relief valve 116 to open, thus venting the cylinder 124 and chamber 110 to atmosphere.

The flow constriction 50 limits the volume flow rate of gas under pressure which can pass through the same, to replace the pressurized gas in conduit 32 and cylinder 124 now being vented to atmosphere. This causes the pressure in the cylinder 124 as well as in conduit 22 and servo valve 20 to drop. As that pressure drops, the strength of the coil spring 132 comes into play, once again causing the piston 120 to be moved to a retracted position. It will be evident from FIG. 2 that when the piston 120 is retracted, the ball 146 can be guided by the conical section 108 to a rest position, again seated on the valve seat 144 comprising the head of the needle valve 142. Once the needle valve 142 has been activated to close the bleed channel 138 and outlet ports 140, the pressure can again build up within the cylinder 124. Such pressure then causes the piston 120 to be moved to its extended position. In that position the motion-sensitive ball 146 is supported on the valve seat 144 of needle valve 142, in a raised position above the conical portion 108. In response to the pressure drop in conduit 22, servo valve 20 opens an exhaust port thereof to permit venting of gas from conduit 16 to the atmosphere and simultaneously opens conduit 24 to permit pressurized gas to flow through conduit 18 into the end 17 of the cylinder of the actuator mechanism 14, thereby causing the piston and its rod 44 to be retracted with consequent movement of target plate 12 to a lowered, inoperative position.

It is noted that full pressurization of the cylinder 124 will not occur until the control valve 54 is next actuated, in readiness to again place the target plate in a raised operative position. Thus, actuation of the control valve 54 again permits gas under pressure to enter the conduit 22, flow through the constriction 50 and into one inlet of the servo valve 20. That gas under pressure is again conducted via conduit 16 to one side 15 of the piston of actuator mechanism 14, causing that piston to be moved to an extended position while simultaneously raising the target plate 12 to an operative position. The entire sequence of activities above-described can occur within a few seconds of a strike on the target plate 12. The actual time will depend upon the operator controlling activation of the target indicating system 10 and manipulation of the "up" control lever or button of control valve 54.

The system above-described is considered to be simple and reliable in operation. Since may parts can readily be made of a polymeric material such as polyethylene, nylon, polyfluoroethylene, or the like, it will not readily be affected adversely by moisture or temperature extremes. Further, since the moveable pistons are basically enclosed, and moveable parts can be lubricated for life, dust, grit or other particles need not constitute a hazard affecting operation of the system. Utilization of parts constructed from a polymeric material will also keep costs to a minimum.

The above disclosure has described a number of configurations and arrangements falling within the scope of this invention. Certain obvious structural modifications will be apparent to those familiar with target indicating systems. It is intended that all such modifications and changes are to be envisaged herein as are encompassed by the claims below.

The embodiments of the invention in which an exclusive property or privilege is claimed are defined as follows:

1. A target indicating system for an ordnance range, operative selectively to signal a strike on a target plate and to selectively move the target plate to a raised operative position and a lowered inoperative position, comprising, an actuator mechanism adapted to be driven by a pressurized gas, being operatively coupled to said target plate to cause selected movement thereof to said lowered and raised positions;

conduit and servo control means in gaseous flow communication with the actuator mechanism, said conduit and servo control means, in use, being adapted to supply said pressurized gas to the actuator mechanism, and a strike sensing assembly being disposed so as to be subject to vibrations in response to a strike on the target plate and being connected in use, to said conduit and servo control means, said assembly including a piston and cylinder arrangement, the cylinder being connected to and pressurizeable via the conduit and servo control means, said piston being operatively connected to biasing means to be slidably moveable thereby and being provided with an internal bleed channel, said arrangement further including valve means for closing said bleed channel and a motion-sensitive weight, said weight being supported on a stem portion of said piston to activate said valve means and close the bleed channel, said weight also being displaceable from said stem portion in response to said vibrations to enable pressure in said cylinder to deactivate the valve means thus opening the bleed channel, causing rapid depressurization of at least portions of the conduit and servo control means and thus cause the correspondingly rapid lowering of the target plate to indicate a strike.

2. The target indicating system defined in claim 1, wherein the actuator mechanism comprises a piston and cylinder arrangement with the piston being connected to the target plate and the cylinder being connected to the conduit and servo control means.

3. The target indicating system defined in claim 1 or 2, wherein the actuator mechanism comprises a dual acting piston and cylinder arrangement, selectively operative both to raise and lower said target plate.

4. An apparatus adapted for use in a target indicating system having a target plate, said apparatus being operative to indicate a strike on the target plate, and comprising:

a housing defining a cylinder therein, one portion of said cylinder being adapted to be in flow communication with and pressurizeable by a source of pressurized gas;

a piston having a stem portion and a head portion in sealed engagement with the cylinder, and being slideably moveable in said cylinder, the piston having a bleed channel therein that is adapted to place the pressurizeable portion of the cylinder in flow communication with atmosphere;

biasing means operatively connected to said piston to selectively move the same;

valve means for closing said bleed channel; and a motion-sensitive weight adapted to be removeably supported by the stem portion of the piston, said weight being operative to activate said valve means to keep said bleed channel closed, said weight being supported in a manner so as to be displaceable in response to vibrations generated by a strike on the target plate enabling deactivation of the valve means by pressure in said cylinder to uncover said bleed channel and thereby cause rapid depressurization of the cylinder and a correspondingly rapid lowering of the target plate to indicate a strike thereof.

5. An apparatus as defined in claim 4, wherein said valve means comprises a needle valve activated by said motion-sensitive weight to close said bleed channel, and the weight is a spherical ball, said needle valve being configured to provide a seat for said ball, whereby the ball causes the needle valve to close said bleed channel.

6. An apparatus as defined in claim 5, wherein said housing includes a cone-shaped section disposed concentrically of the stem portion of the piston, said section functioning to cause repositioning of the ball on said seat automatically following a strike on the target plate.

7. An apparatus as defined in claim 4, 5 or 6 wherein said biasing means is supported by said housing so as to ensure retraction of the piston when the cylinder has been depressurized.

* * * * *